US010712023B2

(12) United States Patent
Kato et al.

(10) Patent No.: US 10,712,023 B2
(45) Date of Patent: Jul. 14, 2020

(54) OUTDOOR UNIT FOR AN AIR-CONDITIONING APPARATUS

(71) Applicant: Mitsubishi Electric Corporation, Tokyo (JP)

(72) Inventors: Yohei Kato, Tokyo (JP); Tsubasa Tanda, Tokyo (JP); Shin Nakamura, Tokyo (JP); Akira Ishibashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/089,100

(22) PCT Filed: Jun. 7, 2016

(86) PCT No.: PCT/JP2016/066903
§ 371 (c)(1),
(2) Date: Sep. 27, 2018

(87) PCT Pub. No.: WO2017/212543
PCT Pub. Date: Dec. 14, 2017

(65) Prior Publication Data

US 2019/0331352 A1 Oct. 31, 2019

(51) Int. Cl.
*F24F 1/18* (2011.01)
*F24F 13/22* (2006.01)
(Continued)

(52) U.S. Cl.
CPC ..... *F24F 1/18* (2013.01); *F24F 13/22* (2013.01); *F28D 1/0476* (2013.01);
(Continued)

(58) Field of Classification Search
CPC ..... F24F 1/18; F24F 1/12; F24F 1/26; F24F 1/30; F24F 1/0067; F24F 13/22;
(Continued)

(56) References Cited

U.S. PATENT DOCUMENTS 5,619,863 A * 4/1997 Kil ..... F24F 1/10 62/428
2005/0155750 A1* 7/2005 Mitchell ..... F28F 1/32 165/182

(Continued)

FOREIGN PATENT DOCUMENTS

CN 104838224 A 8/2015
EP 2 930 456 A1 10/2015

(Continued)

OTHER PUBLICATIONS

Extended European Search Report dated May 2, 2019 issued in corresponding EP patent application No. 16904578.8.

(Continued)

*Primary Examiner* — Emmanuel E Duke
(74) *Attorney, Agent, or Firm* — Posz Law Group, PLC

(57) ABSTRACT

An outdoor unit for an air-conditioning apparatus is configured to suppress damage on hairpin portions at an end portion of an outdoor heat exchanger due to freezing. The outdoor unit includes: an air passage defined inside a casing; an outdoor heat exchanger, which is installed in the air passage, and includes a plurality of heat exchange portions; an outdoor unit fan configured to introduce air into the outdoor heat exchanger; and an air passage blocking object installed in the air passage, and configured to block air flow. The outdoor heat exchanger includes: a heat transfer tube configured to allow refrigerant to pass therein; and a fin connected to the heat transfer tube. The heat transfer tube includes a hairpin portion, which is bent and folded back and to which no fin is connected. The air passage blocking object is configured to cover the hairpin portion.

7 Claims, 8 Drawing Sheets

(51) Int. Cl.

| | |
|---|---|
| ***F28D 1/047*** | (2006.01) |
| ***F28F 19/00*** | (2006.01) |
| *F24F 1/38* | (2011.01) |
| *F24F 1/48* | (2011.01) |

(52) U.S. Cl.
CPC ..... *F28F 19/006* (2013.01); *F24F 1/38* (2013.01); *F24F 1/48* (2013.01); *F24F 2013/221* (2013.01); *F28F 2265/02* (2013.01)

(58) Field of Classification Search
CPC ..... F24F 1/48; F24F 1/38; F24F 2013/221; F28F 19/006; F28F 2265/02; F28F 1/00; F28F 1/10; F28F 1/12; F28F 1/24; F28F 1/32; F28F 1/325; F28D 1/0476; F28D 1/04; F28D 1/047; F25B 39/04; F25D 1/0477
See application file for complete search history.

(56) References Cited

U.S. PATENT DOCUMENTS

| | | | | |
|---|---|---|---|---|
| 2005/0247380 | A1* | 11/2005 | Rottmann | C22C 9/04 148/433 |
| 2011/0073277 | A1* | 3/2011 | Karl | F24F 13/30 165/67 |
| 2014/0196874 | A1 | 7/2014 | Miyake et al. | |
| 2016/0003547 | A1 | 1/2016 | Okazawa et al. | |
| 2016/0238262 | A1* | 8/2016 | Aynur | F28F 9/001 |

FOREIGN PATENT DOCUMENTS

| | | | | |
|---|---|---|---|---|
| GB | 2299656 | | * | 10/1996 |
| GB | 2299656 | A | * | 10/1996 |
| JP | S62-12426 | U | | 1/1987 |
| JP | 2006-226652 | A | | 8/2006 |
| JP | 2013-137126 | A | | 7/2013 |
| JP | 2014-228236 | A | | 12/2014 |
| JP | 2015-132401 | A | | 7/2015 |
| JP | 2016084999 | | * | 5/2016 |
| JP | 2016084999 | A | * | 5/2016 |
| WO | 2013-098872 | A1 | | 7/2013 |
| WO | 2015/097761 | A1 | | 7/2015 |

OTHER PUBLICATIONS

Office Action dated Jul. 30, 2019 issued in corresponding JP patent application No. 2018-522201 (and English translation).
International Search Report dated Aug. 30, 2016 issued in corresponding International patent application No. PCT/JP2016/066903 (and English translation).
Office Action dated Apr. 27, 2020 issued in corresponding CN patent application No. 201680086297.5 (and English translation).

* cited by examiner

OUTDOOR UNIT FOR AN AIR-CONDITIONING APPARATUS

CROSS REFERENCE TO RELATED APPLICATION

This application is a U.S. national stage application of PCT/JP2016/066903 filed on Jun. 7, 2016, the contents of which are incorporated herein by reference.

TECHNICAL FIELD

The present invention relates to an outdoor unit for an air-conditioning apparatus including a heat exchanger.

BACKGROUND ART

There has been known an outdoor unit for an air-conditioning apparatus including a fin-tube heat exchanger mounted thereto. One such heat exchanger includes a flat tube having a sectional shape of a rectangle with rounded corners. The heat exchanger using the flat tube is herein referred to as "flat-tube heat exchanger".

There has been known a flat-tube heat exchanger having the following configuration. That is, U-shaped cutouts are formed in each of fins so as to extend in a width direction from one end of the fin in the width direction, and flat tubes are fitted to the cutouts. In the flat-tube heat exchanger, heat transfer tubes are each formed by bending one flat tube into a U shape. The flat-tube heat exchanger includes a plurality of heat exchange portions. In each of the heat exchange portions, a plurality of flat tubes are arrayed so that longitudinal directions of the elongate shapes are aligned, and the fins are connected to the flat tubes so as to be arrayed with a plurality of predetermined gaps. When seen in a direction along a longitudinal direction of the fins, the flat-tube heat exchanger is typically bent into an L shape or a substantially U shape.

When heat exchangers using flat tubes having the same length are arrayed in a plurality of rows and bent into the L shape, a heat exchanger provided at a position on an outer side of the L-shaped bent part has a bend radius that is different from a bend radius of a heat exchanger provided at a position on an inner side of the L-shaped bent part have different. Therefore, the heat exchanger provided on the inner side of the bent part and the heat exchanger provided on the outer side of the bent part are not aligned at positions of U-shaped bent portions being one end portions of the heat exchangers (hereinafter also referred to as "hairpin portion") or at positions of header connection portions being other end portions. In a heat exchanger of Patent Literature 1, a plurality of rows of heat exchange portions are arrayed with hairpin portions being aligned, the hairpin portions being one end portions.

CITATION LIST

Patent Literature

Patent Literature 1: JP 2014-228236 A

SUMMARY OF INVENTION

Technical Problem

In the related-art flat-tube heat exchanger, when the arrayed hairpin portions of the flat tubes are not aligned, the hairpin portions of the upstream-side heat exchanger provided at the position on the outer side of the L-shaped bent part and fins of the downstream-side heat exchanger provided at the position on the inner side of the L-shaped bent part are arranged in an air passage to be overlapped. When this flat-tube heat exchanger is used as an evaporator in a refrigeration cycle of an air-conditioning apparatus, air passes also through the hairpin portions of the upstream-side heat exchanger overlapping with the fins of the downstream-side heat exchanger, with the result that dew condensation occurs on the hairpin portions of the flat tubes. When a heating operation is performed under a low-temperature outdoor air condition, frost is formed on the hairpin portions of the flat tubes.

When the heating operation is performed under the low-temperature outdoor air condition, the air-conditioning apparatus alternately repeats the heating operation and a defrosting operation. The flat tubes are arranged so that one straight portion of the U-shaped portion is positioned on an upper side and an other straight portion is positioned on a lower side, and moisture content adhering to the upper straight portion of the hairpin portion flows to the lower straight portion along an arc-shaped portion of the U-shaped hairpin portion. Moreover, wide flat portions of the flat tube in a sectional shape are oriented in the up-and-down direction, and hence the moisture content having flowed to the lower straight portion of the hairpin portion is less likely to flow down from the flat portion, with the result that the moisture content is liable to accumulate. When frost is formed on the hairpin portion of the flat tube, the frost is melted by the defrosting operation. However, when the melted water does not completely flow down from the flat tube and remains thereon, the dew condensation water is frozen during the heating operation, and ice is formed.

When part of the ice is not completely melted during the defrosting operation, the moisture content accumulates on the ice, and is frozen during the heating operation. As the heating operation and the defrosting operation are repeated, the ice gradually grows. The heat exchanger is arranged so that the one straight portion of the U-shaped portion of the hairpin portion is positioned on the upper side and the other straight portion is positioned on the lower side. The grown ice further grows so as to connect the upper and lower straight portions to each other. The grown ice may press the flat tube to cause breakage of the pipe.

Meanwhile, according to the disclosure of Patent Literature 1, in the heat exchanger, the plurality of rows of the heat exchange portions are arranged so that respective hairpin portions of the heat exchange portions are aligned. However, fin portions of the respective heat exchange portions have a small space between the fins, and air flows through the fin portions less easily than through the hairpin portions. Therefore, air having sucked into the outdoor unit flows also to the hairpin portions which allow air to easily pass therethrough, with the result that frost is formed similarly to the related-art flat-tube heat exchanger described above. Thus, the moisture content adhering to the flat tubes may be frozen to form ice, and the growth of the ice may cause breakage of the tube.

The present invention has been made to solve the problems described above, and has an object to prevent breakage of a heat transfer tube caused by ice which adheres to a hairpin portion of a heat exchanger and grows thereat.

Solution to Problem

According to one embodiment of the present invention, there is provided an outdoor unit for an air-conditioning apparatus, including: an air passage defined inside a casing; an outdoor heat exchanger installed in the air passage; an outdoor unit fan configured to introduce air into the outdoor heat exchanger; and an air passage blocking object configured to block a flow of part of the air in the air passage, wherein the outdoor heat exchanger includes a heat transfer tube configured to allow refrigerant to pass therein, and a fin connected to the heat transfer tube, wherein the heat transfer tube includes a hairpin portion, which is a portion of the heat transfer tube bent and folded back and to which no fin is connected, and wherein the air passage blocking object is configured to cover the hairpin portion.

Advantageous Effects of Invention

With the outdoor unit for an air-conditioning apparatus according to one embodiment of the present invention, the configuration described above blocks the flow of air to the hairpin portion, thereby being capable of suppressing frost formation and freezing at the hairpin portion. Moreover, the air passage blocking object does not block the fin portion of the heat exchanger, and hence heat exchange performance is not degraded.

DESCRIPTION OF EMBODIMENTS

Embodiment 1

Figure 1:
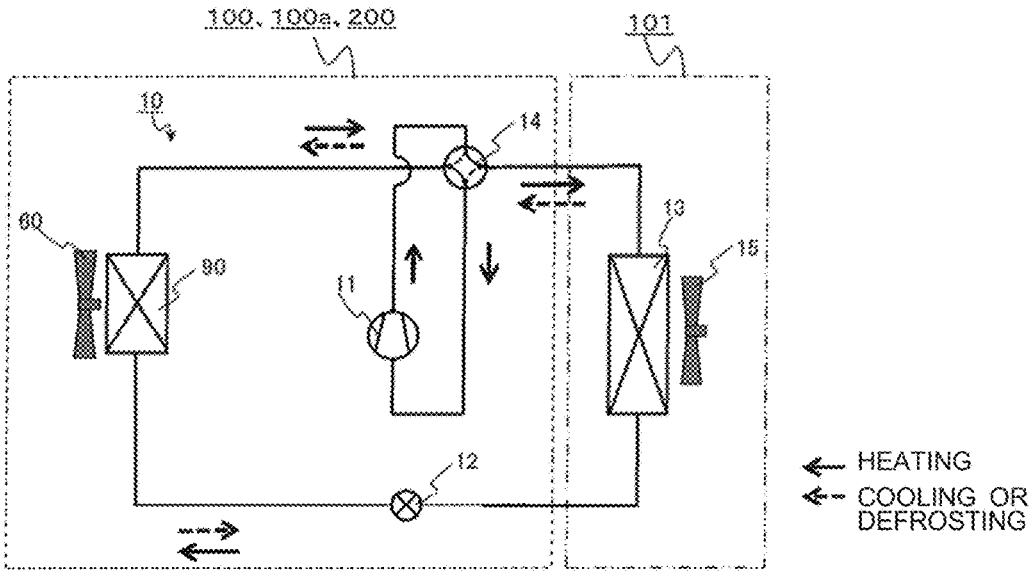
FIG. 1 is a circuit diagram for illustrating a refrigerant circuit including an outdoor unit for an air-conditioning apparatus according to Embodiment 1 of the present invention.

FIG. 1 is a circuit diagram for illustrating a refrigerant circuit 10 including an outdoor unit 100 for an air-conditioning apparatus according to Embodiment 1 of the present invention. Description is made of Embodiment 1 with reference to the drawings.

<Refrigerant Circuit 10 of Air-conditioning Apparatus>

An air-conditioning apparatus in Embodiment 1 includes the refrigerant circuit 10 illustrated in FIG. 1. The refrigerant circuit 10 includes a compressor 11, a flow switching device 14, an outdoor heat exchanger 90, a pressure reducing device 12, and an indoor heat exchanger 13, which are sequentially connected by refrigerant pipes to form a refrigeration cycle circuit. In the refrigerant circuit 10, the portion surrounded by the dotted lines represents the outdoor unit 100. The outdoor unit 100 includes the compressor 11, the flow switching device 14, the outdoor heat exchanger 90, and the pressure reducing device 12, and an outdoor unit fan 60 configured to send air to the outdoor heat exchanger 90 is installed in the vicinity of the outdoor heat exchanger 90. Moreover, in the refrigerant circuit 10, the portion surrounded by the two-dot chain lines represents an indoor unit 101. The indoor unit 101 includes the indoor heat exchanger 13, and an indoor unit fan 15 configured to send indoor air to the indoor heat exchanger 13 is installed in the vicinity of the indoor heat exchanger 13.

The compressor 11 is configured to suck and compress refrigerant to bring the refrigerant into a high-temperature and high-pressure state, and is formed of, for example, a scroll-type compressor or a vane-type compressor. The flow switching device 14 is configured to switch between a heating flow passage and a cooling flow passage in accordance with an operation mode such as a cooling operation or a heating operation, and is formed of, for example, a four-way valve. During the heating operation, the flow switching device 14 connects a discharge side of the compressor 11 and the indoor heat exchanger 13 to each other, and connects the outdoor heat exchanger 90 and a suction side of the compressor 11 to each other. At this time, the refrigerant flows along the paths of the flow switching device 14 indicated by the solid lines in the refrigerant circuit diagram of FIG. 1. Meanwhile, during the cooling operation, the flow switching device 14 connects the discharge side of the compressor 11 and the outdoor heat exchanger 90 to each other, and connects the indoor heat exchanger 13 and the suction side of the compressor 11 to each other. At this time, the refrigerant flows along the paths of the flow switching device indicated by the broken lines in the refrigerant circuit diagram of FIG. 1. Illustration is given of the example case in which the four-way valve is used as the flow switching device 14. However, the flow switching device 14 is not limited to the four-way valve, and may be formed of, for example, a combination of a plurality of two-way valves.

The outdoor heat exchanger 90 is configured to exchange heat between refrigerant and outdoor air. The outdoor unit fan 60 installed in the vicinity of the outdoor heat exchanger 90 is configured to send outdoor air to the outdoor heat exchanger 90.

The pressure reducing device 12 is provided between the indoor heat exchanger 13 and the outdoor heat exchanger 90, and is configured to adjust a state of refrigerant by adjusting a flow rate. The pressure reducing device 12 is formed of, for example, an expansion device or an open/close valve configured to switch on and off the flow of refrigerant by opening and closing.

<Operation of Refrigerant Circuit 10 during Heating Operation>

Next, description is made of operation examples of a refrigeration cycle in Embodiment 1. First, description is made of an operation example of the refrigerant circuit 10 in the case of the heating operation in which the outdoor heat exchanger 90 operates as an evaporator. In FIG. 1, during the heating, the refrigerant flows in the direction of the arrows indicated by the solid lines in FIG. 1. Also in the flow switching device 14, the refrigerant flows along the paths indicated by the solid lines. The refrigerant is compressed into high-temperature and high-pressure gas refrigerant in the compressor 11. The high-temperature and high-pressure gas refrigerant having been discharged from the compressor 11 flows into the indoor heat exchanger 13 through the flow switching device 14. The high-temperature and high-pressure gas refrigerant having flowed into the indoor heat exchanger 13 rejects heat in the indoor heat exchanger 13 and is condensed from gas into liquid. The heat having been rejected in the indoor heat exchanger 13 heats air in an indoor space in which the indoor unit 101 is installed. The refrigerant having been condensed in the indoor heat exchanger 13 flows from the indoor heat exchanger 13 into the pressure reducing device 12 and is reduced in pressure to be brought into a two-phase gas-liquid state. The refrigerant having been reduced in pressure to be brought into the two-phase gas-liquid state flows into the outdoor heat exchanger 90, is evaporated through removal of heat from the air sent into the outdoor heat exchanger 90 by the outdoor unit fan 60, and is sucked into the compressor 11 through the flow switching device 14.

<Operations of Refrigerant Circuit 10 during Cooling Operation and Defrosting Operation>

Next, description is made of an operation example of the refrigerant circuit 10 in the case of the cooling operation in which the outdoor heat exchanger 90 operates as a condenser. During the cooling, the refrigerant flows in the direction of the arrows indicated by the broken lines in FIG. 1. Also in the flow switching device 14, the refrigerant flows along the paths indicated by the broken lines. The refrigerant is compressed into high-temperature and high-pressure gas refrigerant in the compressor 11. The high-temperature and high-pressure gas refrigerant having been discharged from the compressor 11 flows into the outdoor heat exchanger 90 through the flow switching device 14. The high-temperature and high-pressure gas refrigerant having flowed into the outdoor heat exchanger 90 exchanges heat with air sent from the outdoor unit fan 60, rejects heat, and is condensed from gas into liquid.

The refrigerant having been condensed in the outdoor heat exchanger 90 flows from the outdoor heat exchanger 90 into the pressure reducing device 12 and is reduced in pressure to be brought into a two-phase gas-liquid state. The refrigerant having been reduced in pressure to be brought into the two-phase gas-liquid state flows into the indoor heat exchanger 13, is evaporated through exchange of heat with the indoor air sent by the indoor unit fan 15, and is sucked into the compressor 11 through the flow switching device 14.

<Configuration of Outdoor Unit 100>

Figure 2:
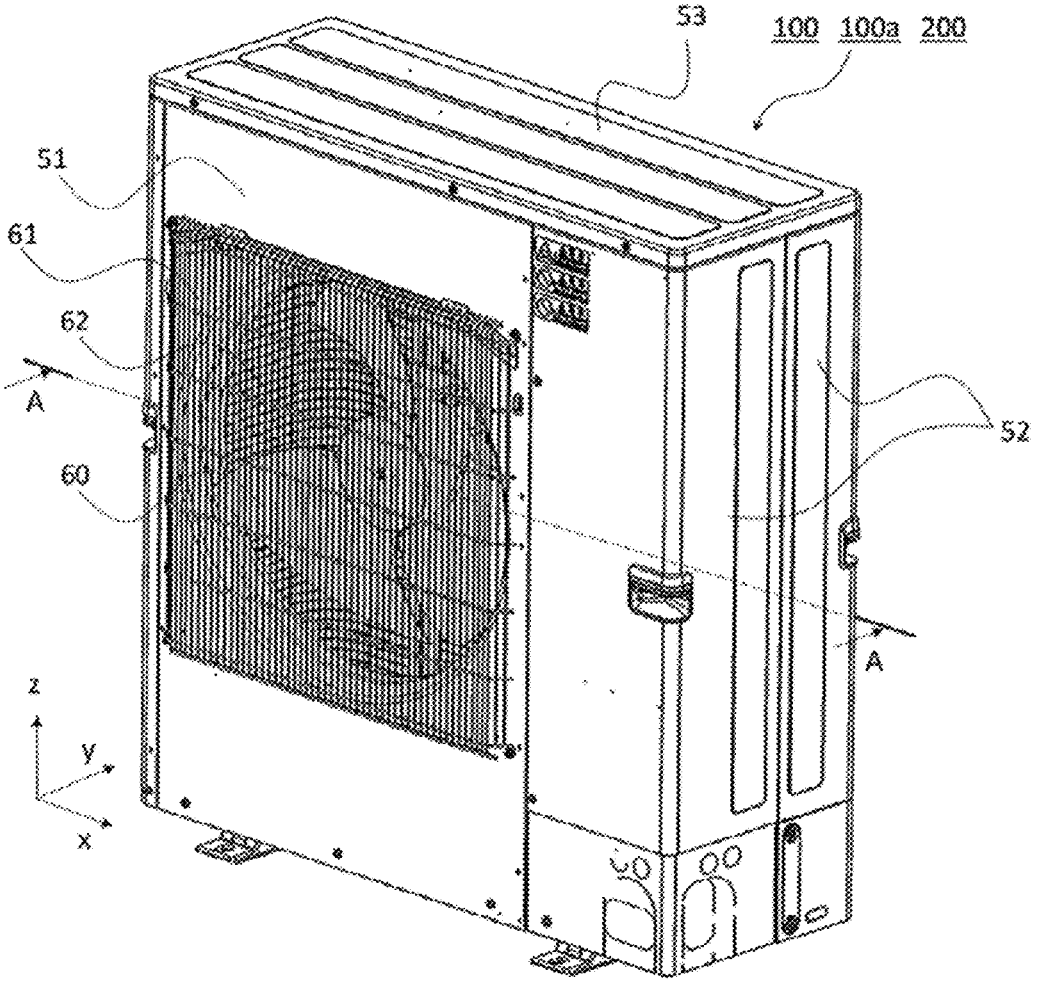
FIG. 2 is a perspective view for illustrating the outdoor unit for an air-conditioning apparatus according to Embodiment 1 of the present invention.
Figure 3:
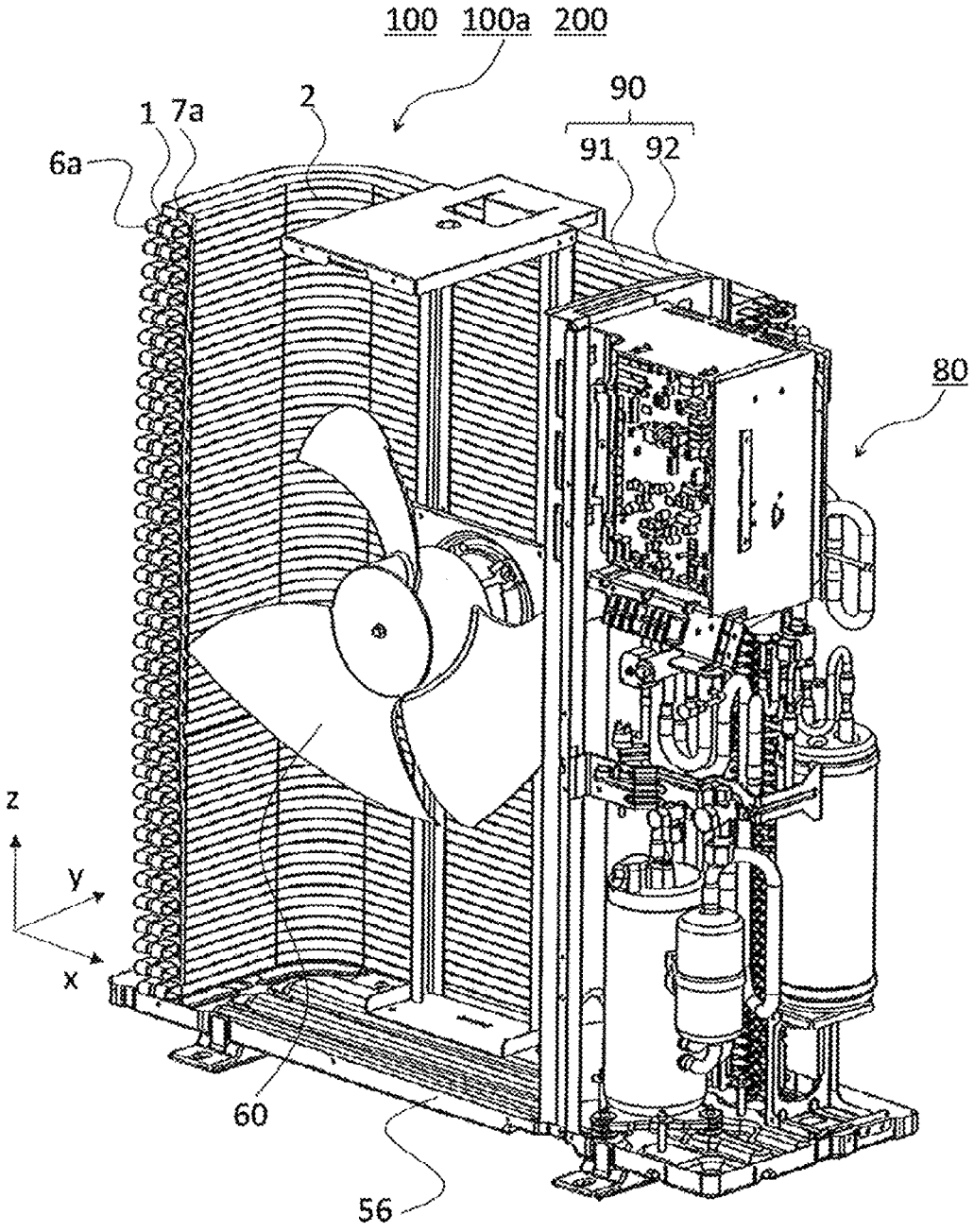
FIG. 3 is a perspective view for illustrating a state in which an exterior cover component of the outdoor unit illustrated in FIG. 2 is removed.
Figure 4:
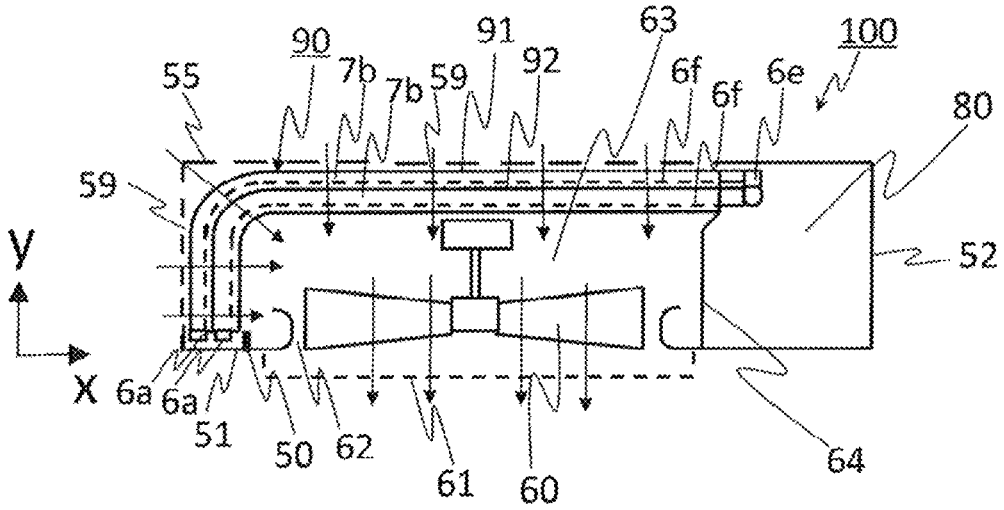
FIG. 4 is an explanatory view for illustrating an A-A cross section of FIG. 2.

FIG. 2 is a perspective view for illustrating the outdoor unit 100 for an air-conditioning apparatus according to Embodiment 1 of the present invention. FIG. 3 is a perspective view for illustrating a state in which an exterior cover component of the outdoor unit 100 illustrated in FIG. 2 is removed. FIG. 4 is an explanatory view for illustrating an A-A cross section of FIG. 2. The x-direction, y-direction, and z-direction described below correspond to the x-direction, y-direction, and z-direction illustrated in the drawings, respectively.

The outdoor unit 100 has, for example, a substantially rectangular parallelepiped casing. That is, as illustrated in FIG. 2, the outdoor unit 100 includes a front panel 51 forming a front surface side of the casing of the outdoor unit 100, a side panel 52 forming a side surface side of the casing, and a top panel 53 forming a top surface side of the casing. Moreover, as illustrated in FIG. 4, the outdoor unit 100 includes a rear panel 55 configured to cover a rear surface side and a side surface side, which is a side opposed to the side panel 52, of the outdoor unit 100. The rear panel 55 has an air inlet 59 for taking air into the outdoor unit 100. The front panel 51 of the outdoor unit 100 has an air outlet 62 for discharging air to an outside. An outer side of the air outlet 62 is covered with a fan guard 61. The configuration of the casing of the outdoor unit 100 is not limited to the configuration described above, and may suitably be changed. The panels such as the front panel 51 forming the casing of the outdoor unit 100 may be integrally formed in combination. Moreover, each panel may further be formed of a plurality of separate panels.

A space inside the outdoor unit 100 is partitioned by a separator 64 into a machine chamber 80 and an air passage 63. The machine chamber 80 accommodates the compressor 11, the pressure reducing device 12, and the flow switching device 14. In the air passage 63, the outdoor heat exchanger 90 is arranged on an upstream side, and the outdoor unit fan 60 is arranged on a downstream side. As illustrated in FIG. 4, the outdoor heat exchanger 90 has one end arranged in the machine chamber 80. At the one end of the outdoor heat exchanger 90 arranged in the machine chamber 80, joint portions **6*e* are provided. The joint portions 6*e* are connected to one ends of heat transfer tubes 1 of the outdoor heat exchanger 90. Although illustration is omitted in FIG. 3 and FIG. 4, the joint portions 6*e* of the outdoor heat exchanger 90, which are arranged in the machine chamber 80, are connected to the pressure reducing device 12 and the flow switching device 14 by refrigerant pipes, and form the refrigerant circuit 10**.

As indicated by the arrows in FIG. 4, the outdoor unit fan 60 installed in the air passage 63 is configured to suck air outside the outdoor unit 100 into the outdoor unit 100 through the air inlet 59 and blow out the air through the air outlet 62. As illustrated in FIG. 4, the outdoor heat exchanger 90 has an L shape as seen from the top surface side, and is arranged so as to extend along the air inlet 59 formed in the rear panel 55. That is, the outdoor heat exchanger 90 is arranged over an entire region of the air passage 63 so as to block a flow of air from the air inlet 59 to the air outlet 62. With such a configuration, the air having flowed into the air passage 63 inside the outdoor unit 100 through the air inlet 59 passes through the outdoor heat exchanger 90, exchanges heat with refrigerant flowing inside the outdoor heat exchanger 90, and is blown out through the air outlet 62. In Embodiment 1, the outdoor heat exchanger 90 is bent into the L shape. However, the outdoor heat exchanger 90 may have, for example, a rectangular shape having one open side, that is, a substantially U shape having two or more bent parts.

As illustrated in FIG. 3 and FIG. 4, the outdoor heat exchanger 90 includes two heat exchange portions. The heat exchange portions include an upstream-side heat exchange portion 91 arranged on the upstream side in the air passage 63 and a downstream-side heat exchange portion 92 arranged on the downstream side in the air passage 63. In each of the upstream-side heat exchange portion 91 and the downstream-side heat exchange portion 92, a plurality of fins 2 are mounted so as to be arrayed at predetermined intervals along a refrigerant flow passage of the heat transfer tubes 1. The upstream-side heat exchange portion 91 and the downstream-side heat exchange portion 92 are arrayed in the air flow direction in the air passage 63 so that respective fin installation portions 7*b* at which the fins 2 are arrayed overlap each other.

A base panel 56 is arranged at a lower portion of the outdoor unit 100, and forms a bottom surface side of the casing of the outdoor unit 100. The base panel 56 is configured to support, for example, the outdoor heat exchanger 90, the outdoor unit fan 60, and the compressor 11, the pressure reducing device 12, and the flow switching device 14 which are accommodated in the machine chamber 80.

<Outdoor Heat Exchanger 90>

As described above, the outdoor heat exchanger 90 includes the two heat exchange portions. The two heat exchange portions include the upstream-side heat exchange portion 91 arranged on the upstream side in the air passage 63 and the downstream-side heat exchange portion 92 arranged on the downstream side in the air passage 63. In Embodiment 1, the outdoor heat exchanger 90 includes two rows of heat exchange portions. However, the number of rows of the heat exchange portions is not limited to two, and three or more rows of heat exchange portions may be arrayed from the upstream side to the downstream side in the air passage 63.

<Heat Transfer Pipe 1>

Figure 5:
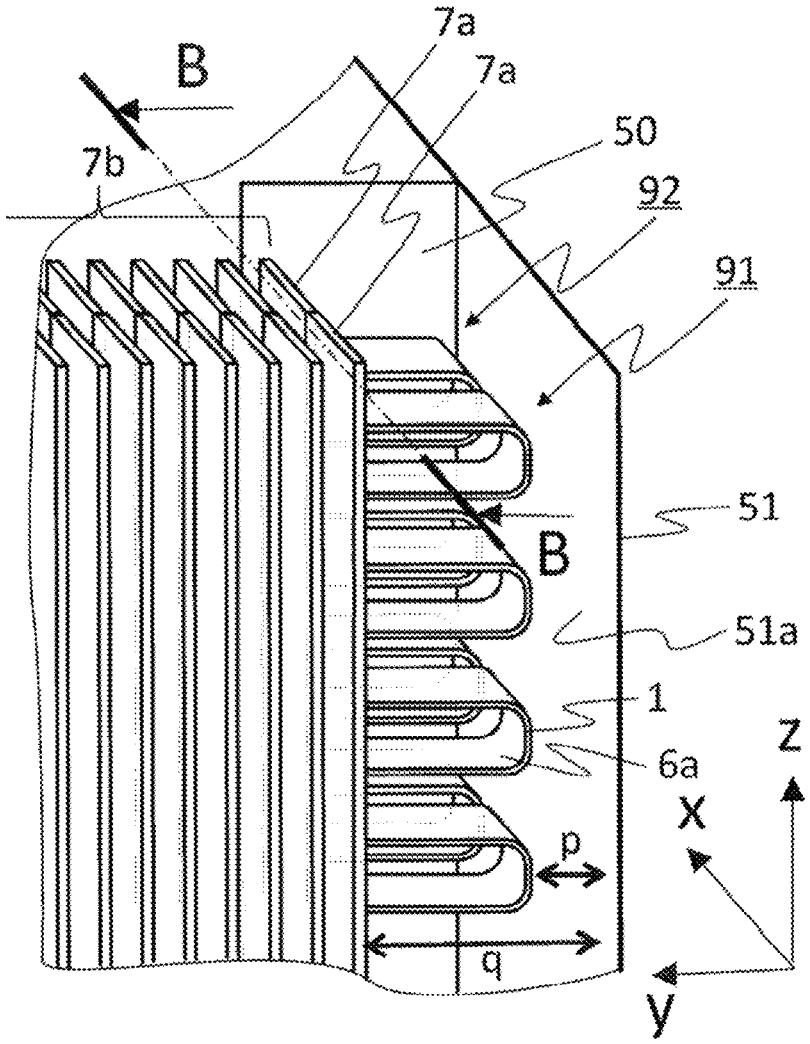
FIG. 5 is a perspective view for illustrating an end portion of an outdoor heat exchanger illustrated in FIG. 2 to FIG. 4 on a hairpin portion side.

FIG. 5 is a perspective view for illustrating an end portion of the outdoor heat exchanger 90 illustrated in FIG. 2 to FIG. 4 on a hairpin portion 6*a* side.

As illustrated in FIG. 5, in each of the upstream-side heat exchange portion 91 and the downstream-side heat exchange portion 92, the plurality of heat transfer tubes 1 are arrayed in the z-direction, and the fins 2 are mounted so as to be orthogonal to the plurality of heat transfer tubes 1. The heat transfer tubes 1 are each bent into an L shape as seen from the top surface side of the outdoor unit 100. The plurality of fins 2 are arrayed in a direction along the refrigerant flow passage of the heat transfer tubes 1 bent into the L shape, and the plurality of fins 2 are mounted at predetermined intervals. The heat transfer tubes 1 forming the upstream-side heat exchange portion 91 and the downstream-side heat exchange portion 92 extend from the joint portions 6*e* being the end portions on the machine chamber 80 side toward other end portions, are bent downward and folded back at the other end portions, and return to the machine chamber 80. At the other end portion, the heat transfer tubes 1 have no fin 2 mounted thereto and are exposed, and are bent into the U shape. A part of the heat exchanger pipe 1 exposed at the other end portion is particularly referred to as "hairpin portion 6*a*". In one heat transfer tube 1, pipe portions 6*f* extending between the joint portion 6*e* and the hairpin portion 6*a* are arrayed in the up-and-down direction of the outdoor unit 100, and are parallel to each other. As seen from the top surface of the outdoor unit 100, the upper and lower pipe portions 6*f* pass along the same path. The pipe portions 6*f* are each a part indicated by the dotted line in FIG. 4, and the fins 2 are mounted at this part to be the fin installation portion 7*b*.

As illustrated in FIG. 4, on the end portion side of the heat transfer tubes 1 opposite to the side on which the hairpin portions 6*a* are connected, there are provided the joint portions 6*e* to which header pipes (not shown) are connected. The inside of the heat transfer tube 1 is a flow passage for refrigerant, and the refrigerant flows in from the joint portion 6*e* side, turns back at the hairpin portion 6*a*, and returns to the joint portion 6*e* side. In each of the heat transfer tubes 1 forming the upstream-side heat exchange portion 91 and the downstream-side heat exchange portion 92, the refrigerant flows into the heat transfer tube 1 through one of two end portions of the heat transfer tube 1 arranged on the joint portion 6*e* side, passes through one pipe portion 6*f*, turns back at the hairpin portion 6*a*, passes through the other pipe portion 6*f*, returns to the join portion 6*e* side, and flows out from the outdoor heat exchanger 90. As the heat exchange medium which flows inside the heat transfer tube 1, fluid such as water, refrigerant, or brine is used.

In Embodiment 1, in particular, a flat tube is used as the heat transfer tube 1. The heat transfer tube 1 has a sectional shape of a rectangle with rounded corners, and the rectangle has a predetermined aspect ratio. Moreover, the heat transfer tube 1 is formed of a hollow metal pipe, which is made of metal having favorable thermal conductivity such as aluminum or copper. In Embodiment 1, the flat tube is used as the heat transfer tube 1. However, the present invention is not limited to this, and a pipe having a sectional shape of a circle may be used.

<Fin 2>

The fin 2 is formed into a thin plate shape, and has a plurality of cutout portions 3 for receiving the heat transfer tubes 1 inserted thereinto. The plurality of cutout portions 3 are formed at a constant pitch along a longitudinal direction of the fin 2. As illustrated in FIG. 3, the fin 2 has a sectional shape of a rectangle with rounded corners. That is, the cutout portion 3 is formed in conformity with the sectional shape of the heat transfer tube 1 so that the heat transfer tube 1 can be inserted into the cutout portion 3. The fin 2 receives the heat transfer tubes 1 inserted into the cutout portions 3, and is fixed to the heat transfer tubes 1 at the cutout portions 3 by, for example, brazing. The plurality of fins 2 are mounted so as to be arrayed at predetermined intervals along a longitudinal direction of the heat transfer tube 1, that is, along an extending direction of the refrigerant flow passage inside the heat transfer tube 1. However, the fin 2 is not mounted in a periphery of the hairpin portions 6*a* of the heat transfer tubes 1, and the heat transfer tubes 1 are exposed.

Figure 6:
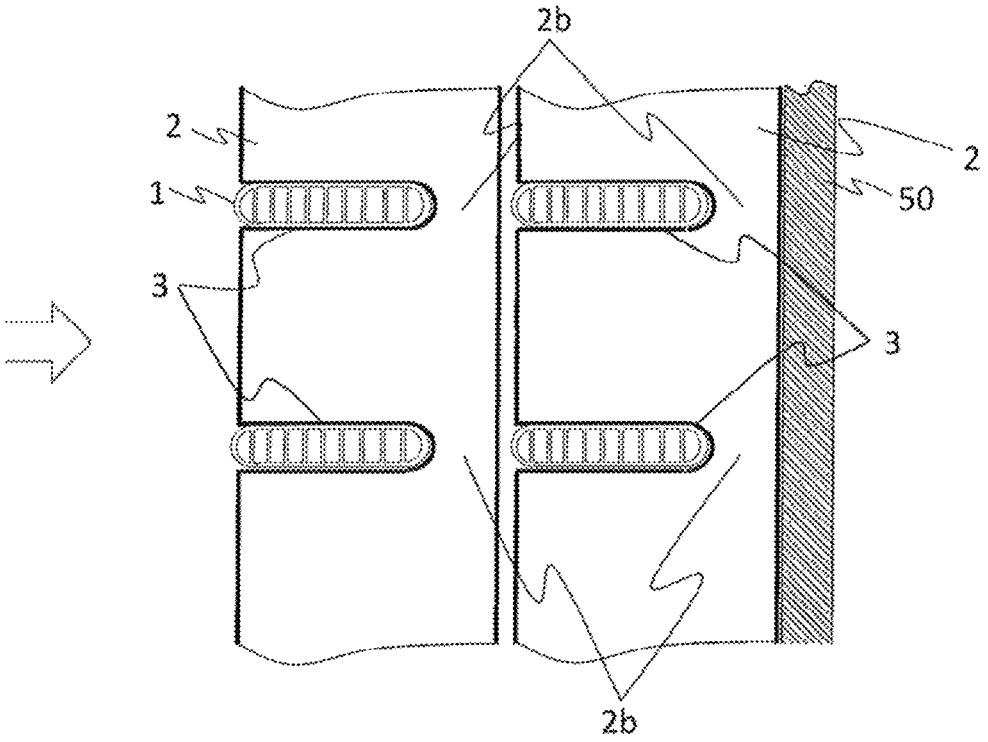
FIG. 6 is an explanatory view for illustrating a B-B cross section of FIG. 5.

FIG. 6 is an explanatory view for illustrating a B-B cross section of FIG. 5. The cutout portion 3 of the fin 2 extends from one end portion to an other end portion in a direction orthogonal to the longitudinal direction of the fin 2. In Embodiment 1, the cutout portion 3 is opened on the upstream side in the air passage 63. In FIG. 5, illustration of the cutout portions 3 is omitted. With such a configuration, edge portions 2*b*, which are connected portions of a plate remaining after cutting out the fin 2, allows the heat transfer tubes 1 to be arranged apart from an air passage blocking object 50. Thus, when the outdoor unit 100 is to be assembled, contact of the air passage blocking object 50 with the heat transfer tubes 1 can be prevented, thereby being capable of preventing damage on the hairpin portions 6*a*. When the air passage blocking object 50 is provided on the upstream side of the outdoor heat exchanger 90, a similar effect can be attained by arranging the fin 2 so that the opening side of the cutout portions 3 is oriented toward the downstream side.

<Arrangement of Outdoor Heat Exchanger 90>

As illustrated in FIG. 4, the outdoor heat exchanger 90 is arranged in the air passage 63 inside the outdoor unit 100, and is arranged so as to extend along the air inlet 59. The fin installation portions 7*b* of the upstream-side heat exchange portion 91 and the downstream-side heat exchange portion 92 are arranged so as to cover an entire region of the air inlet 59. With such arrangement, the air having flowed in through the air inlet 59 passes through the plurality of fins 2, thereby promoting heat exchange with the refrigerant flowing in the heat transfer tubes 1.

In Embodiment 1, the upstream-side heat exchange portion 91 and the downstream-side heat exchange portion 92 are arranged so that ends of the hairpin portions 6*a* are aligned. In other words, the upstream-side heat exchange portion 91 and the downstream-side heat exchange portion 92 are arranged so that positions of ends of the hairpin portions 6*a* in a direction along the refrigerant flow passage of the heat transfer tubes 1 are aligned. The hairpin portions 6*a* are arranged in the vicinity of the front panel 51, and the ends of the hairpin portions 6*a* are arranged apart from the front panel 51 with a predetermined gap "p". Moreover, fin end portions 7*a*, which are end portions of the portions at which the fins 2 of the upstream-side heat exchange portion 91 and the downstream-side heat exchange portion 92 are arranged, are also arranged so that positions thereof in the longitudinal direction of the heat transfer tubes 1 are aligned. The fin end portions 7*a* are arranged apart from the front panel 51 by a predetermined distance "q". With the arrangement in which the positions of the fin end portions 7*a* of the upstream-side heat exchange portion 91 and the downstream-side heat exchange portion 92 are aligned, the air having passed through the fins 2 of the upstream-side heat exchange portion 91 passes through the fins 2 of the downstream-side heat exchange portion.

<Configuration of Air Passage Blocking Object 50>

In Embodiment 1, the air passage blocking object 50 is arranged in the vicinity of the hairpin portions 6*a* of the outdoor heat exchanger 90. The air passage blocking object 50 is installed on a wall surface 51*a* on an inner side of the front panel 51, and is provided upright on the wall surface 51*a* on the inner side of the front panel 51 so as to block the flow of air in the air passage 63. The air passage blocking object 50 is, for example, provided integrally with the wall surface 51*a*. Alternatively, the air passage blocking object 50 may be fixed to the wall surface 51*a* by a method such as fastening with screws.

Figure 7:
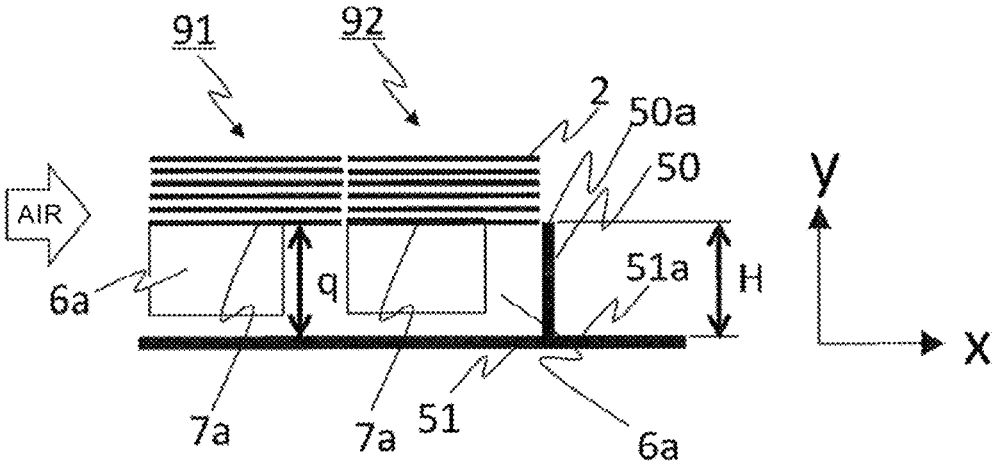
FIG. 7 is an enlarged view for illustrating a periphery of the hairpin portions of the outdoor heat exchanger in FIG. 4.

FIG. 7 is an enlarged view for illustrating a periphery of the hairpin portions 6*a* of the outdoor heat exchanger 90 in FIG. 4.

In Embodiment 1, the air passage blocking object 50 is arranged on the downstream side of the hairpin portions 6*a* and the fin end portion 7*a* of the downstream-side heat exchange portion 92. The air passage blocking object 50 extends in a direction from the wall surface 51*a* on the inner side of the front panel 51 to the position at which the fin end portion 7*a* of the downstream-side heat exchange portion 92 is installed. A height H of the air passage blocking object 50 from the wall surface 51*a* on the inner side of the front panel 51 is set equal to or larger than the distance "q" from the wall surface 51*a* on the inner side of the front panel 51 to the fin end portion 7*a*. Moreover, the air passage blocking object 50 has a sectional shape illustrated in FIG. 6 and extends in the up-and-down direction of the outdoor unit 100. The air passage blocking object 50 is installed so as to cover the entirety of the plurality of hairpin portions 6*a* of the downstream-side heat exchange portion 92 from the downstream side in the air passage. With such a configuration, the air flowing in through the air inlet 59 passes on the fin installation portion 7*b* side in the outdoor heat exchanger 90. The downstream side of the hairpin portions 6*a* in the air passage 63 is blocked, and hence the air is prevented from flowing in. The air passage blocking object 50 is not limited to the case of being installed so as to cover the entirety of the hairpin portions 6*a*, and may have a configuration in which a cutout portion is partially formed so that part of the hairpin portions 6*a* is not covered. In this case, there is a risk of causing freezing due to inflow of the air into the part of the hairpin portions 6*a*. However, the freezing is limited to the part of the hairpin portions 6*a*, and hence the freezing can be prevented by, for example, control of the defrosting operation. Moreover, even when the cutout portion is formed at a part of the air passage blocking object 50, for example, the cutout portion may be closed with a separate component which is present in the vicinity of the outdoor heat exchanger 90.

Moreover, a distal end portion 50*a* of the air passage blocking object 50 extending toward the inner side of the air passage 63 from the wall surface 51*a* may be held in abutment against the fin installation portion 7*b*. An interference member such as a rubber sheet may be interposed at a portion at which the distal end portion 50*a* and the fin installation portion 7*b* are held in abutment against each other. With such a configuration, a gap which allows the air to flow therethrough is not formed between the fin installation portion 7*b* and the air passage blocking object 50, thereby being capable of improving the effect of suppressing the inflow of the air to the hairpin portions 6*a*.

<Comparative Example>

Figure 8:
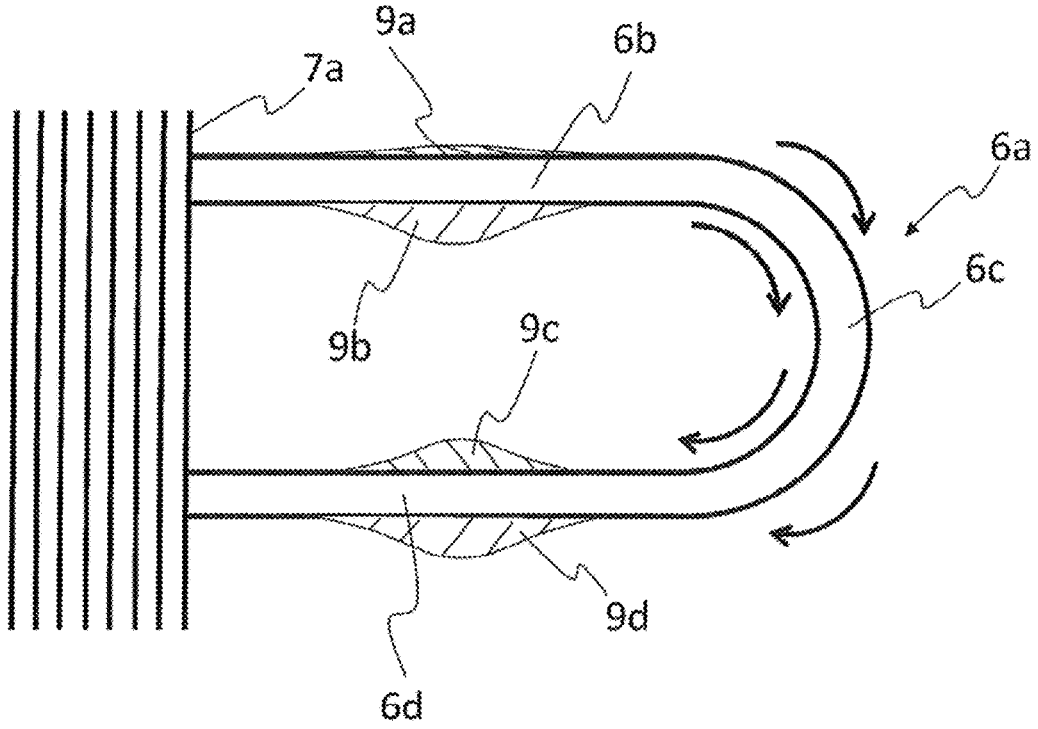
FIG. 8 Related Art
FIG. 8 is an enlarged view for illustrating a hairpin portion of an outdoor heat exchanger in a comparative example.
Figure 9:
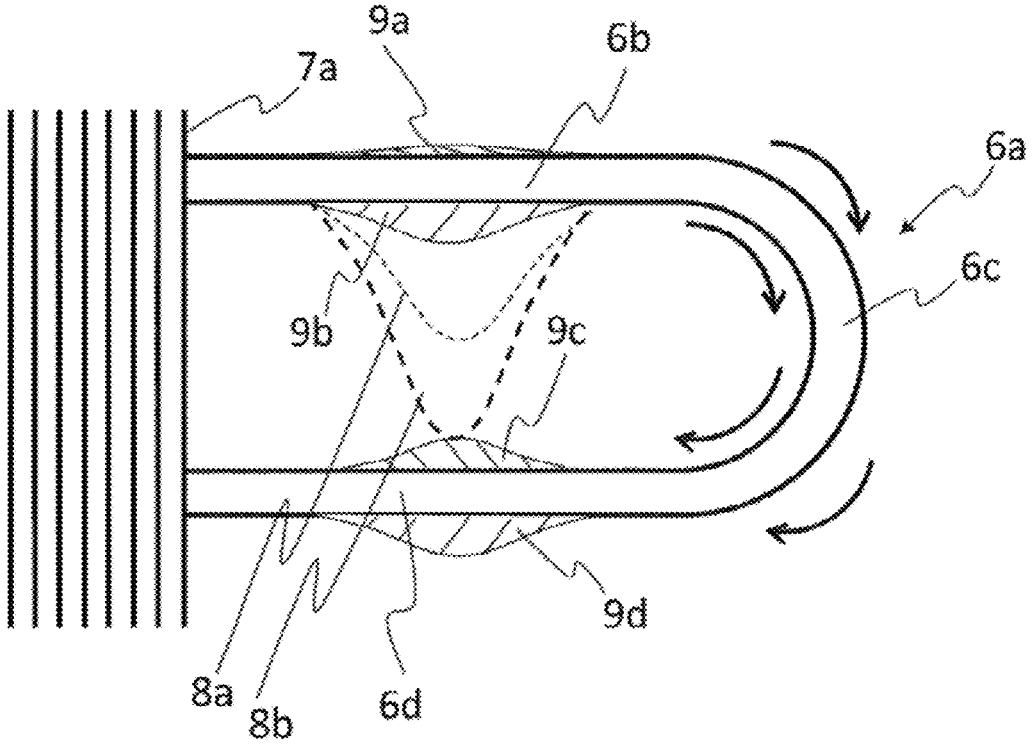
FIG. 9 Related Art
FIG. 9 is an enlarged view for illustrating the hairpin portion of the outdoor heat exchanger in the comparative example.

FIG. 8 and FIG. 9 are enlarged views for illustrating a hairpin portion 6*a* of an outdoor heat exchanger 90 of an outdoor unit 100*a* for an air-conditioning apparatus in a comparative example. The outdoor unit 100*a* for an air-conditioning apparatus in the comparative example is different from the outdoor unit 100 in that the air passage blocking object 50 is not provided. Other configurations are the same in the outdoor unit 100 and the outdoor unit 100*a*. Thus, in the following description, common portions are described with the same reference symbols.

When the air-conditioning apparatus performs the heating operation, the outdoor heat exchanger 90 operates as an evaporator. Thus, when the air having flowed into the air inlet 59 contains a large amount of moisture, dew condensation water is generated in the outdoor heat exchanger 90. In particular, when the temperature of the air is low, the dew condensation water is frozen, and frost adheres to the fins 2 or the heat transfer tubes 1. When frost adheres to the outdoor heat exchanger 90, the fins 2 are clogged and cause the air to be less likely to pass therethrough, with the result that heat exchange efficiency is degraded. With this, the efficiency of the refrigeration cycle is also degraded, with the result that the air-conditioning performance of the air-conditioning apparatus is degraded. Therefore, in the air-conditioning apparatus, the heating operation and the defrosting operation are alternately repeated to melt the frost adhering to the outdoor heat exchanger 90, thereby performing control of preventing degradation in heat exchange efficiency.

In the outdoor unit 100*a* in the comparative example, the air passage blocking object 50 is not installed. Therefore, the air having flowed in through the air inlet 59 is liable to pass through the hairpin portions 6*a* of the outdoor heat exchanger 90. The fins 2 are not provided at the hairpin portions 6*a*, but the heat transfer tubes 1 are exposed to the air having flowed in through the air inlet 59, with the result that frost is formed. The frost adhering to the hairpin portion 6*a* is melted by the defrosting operation to be formed into dew condensation water. As illustrated in FIG. 8 and FIG. 9, part of the dew condensation water remains adhering to a horizontal portion 6*b* on the upper side of the hairpin portion 6*a*, and flowing dew condensation water also flows along an arc portion 6*c* of the hairpin portion 6*a* in the direction indicated by the arrows in FIG. 8 and FIG. 9, and flows to a horizontal portion 6*d* on the lower side. In such a manner, during the defrosting operation, dew condensation waters 9*a*, 9*b*, 9*c*, and 9*d* adhere to the horizontal portions 6*b* and 6*d* of the hairpin portion 6*a*.

As described above, when the operation of the air-conditioning apparatus is switched to the heating operation while the dew condensation waters 9*a*, 9*b*, 9*c*, and 9*d* keep adhering to the hairpin portion 6*a*, the dew condensation waters 9*a*, 9*b*, 9*c*, and 9*d* are frozen again. Moreover, frost is newly formed on the hairpin portion 6*a* by passing air. Then, when the operation of the air-conditioning apparatus is switched to the defrosting operation again, the frost having adhered to the hairpin portion 6*a* during the heating operation and ice formed by freezing of the dew condensation water having remained during the previous defrosting operation are melted. However, when unmelted ice remains on the hairpin portion 6*a*, the melted frost or dew condensation water formed by the ice further adheres to the ice and is frozen during the heating operation. As a result, the ice is gradually increased in size, for example, as indicated by an ice 8*a* in FIG. 9, and is further combined with ice formed by freezing of the dew condensation water 9*d* accumulated on the horizontal portion 6*d* on the lower side as indicated by an ice 8*b*.

The ice formed on the hairpin portion 6*a* in the manner described above grows so as to connect the horizontal portion 6*b* on the upper side and the horizontal portion 6*d* on the lower side to each other, and presses the horizontal portion 6*b* and the horizontal portion 6*d* in the up-and-down direction. As a result, the heat transfer tube 1 is broken from the portion pressed by ice. As described above, the outdoor unit 100*a* in the comparative example does not include the air passage blocking object 50, and hence the hairpin portion 6*a* is frozen, with the result that the heat transfer tube 1 is broken.

<Effect of Embodiment 1>

In Embodiment 1 and the comparative example, use of the flat tube as the heat transfer tube 1 causes the dew condensation water to be liable to remain on the heat transfer tube 1. Therefore, when the flat tube is to be used for the outdoor heat exchanger 90, there is higher necessity to take a countermeasure to prevent exposure of the hairpin portion 6*a* to the air as compared to the case of using a pipe having a circular cross section as the heat transfer tube 1. The outdoor unit 100 according to Embodiment 1 has a configuration in which, as illustrated in FIG. 6, the air passage blocking object 50 causes the air to be less likely to pass through the hairpin portion 6*a*, thereby being capable of preventing freezing unlike the hairpin portion 6*a* in the comparative example. Therefore, the breakage of the heat transfer tube 1 can be prevented. Moreover, the air passage blocking object 50 is installed so as to cover only the hairpin portion 6*a*, that is, block the air passage 63 in a range of from the fin end portion 7*a* to the wall surface 51*a* on the inner side of the front panel 51. Therefore, the air passing through the fins 2 is not blocked, and hence the performance of the outdoor heat exchanger 90 is not degraded.

Figure 10:
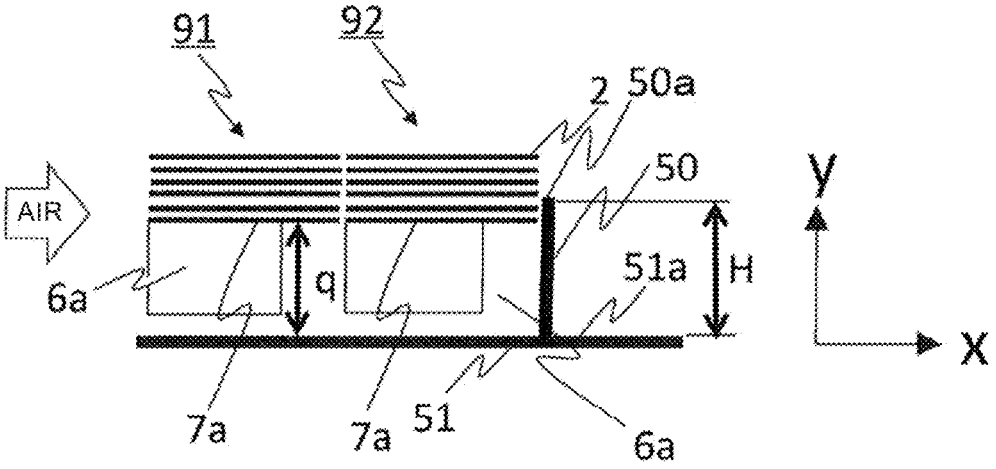
FIG. 10 is an illustration of an air passage blocking object illustrated in FIG. 7, which is changed in height.

FIG. 10 is an illustration of the air passage blocking object 50 illustrated in FIG. 7, which is changed in height.

The height H of the air passage blocking object 50 from the wall surface 51*a* on the inner side of the front panel 51 is set equal to or larger than the distance "q" from the wall surface 51*a* on the inner side of the front panel 51 to the fin end portion 7*a*. As illustrated in FIG. 10, when the height H is set larger than the distance "q" so that the air passage blocking object 50 and the fins 2 of the downstream-side heat exchange portion 92 overlap each other, inflow of the air to the hairpin portions 6*a* can be suppressed even when there is dimensional variation given at the time of manufacturing.

(1) The outdoor unit 100 for an air-conditioning apparatus according to Embodiment 1 includes the air passage 63 defined inside the casing, the outdoor heat exchanger 90 installed in the air passage 63, the outdoor unit fan 60 configured to introduce air into the outdoor heat exchanger 90, and the air passage blocking object 50 configured to block a flow of part of the air in the air passage 63. The outdoor heat exchanger 90 includes the heat transfer tubes 1 configured to allow refrigerant to pass therein, and the fins 2 connected to the heat transfer tubes 1. The heat transfer tubes 1 include the hairpin portions 6*a*, which are portions of the heat transfer tubes 1 bent and folded back and have no fin 2 mounted thereto. The air passage blocking object 50 is configured to cover the hairpin portions 6*a*.

Alternatively, the air passage blocking object 50 is configured to block airflow in a space in the air passage 63 which is defined between the wall surface 51*a* forming the air passage 63 on the side on which the hairpin portions 6*a* are arranged, and the end surfaces of the fins 2 on the side on which the hairpin portions 6*a* are arranged.

With such a configuration, the outdoor unit 100 for an air-conditioning apparatus is capable of suppressing inflow of air outside the outdoor unit 100 into the hairpin portions 6*a* of the outdoor heat exchanger 90. The air is prevented from flowing into the hairpin portions 6*a*. Hence, occurrence of dew condensation and frost formation on the hairpin portions 6*a* can be prevented, and damage on the hairpin portions 6*a* due to freezing can be prevented.

(2) In the outdoor unit 100 for an air-conditioning apparatus according to Embodiment 1, the air passage blocking object 50 is provided upright on the wall surface 51*a* defining the air passage 63 on the side on which the hairpin portions 6*a* are arranged. The height of the air passage blocking object 50 from the wall surface 51*a* is set equal to or larger than the distance "q" from the fin end portion 7*a*, which is closest from the wall surface 51*a*, to the wall surface 51*a*.

With such a configuration, the outdoor unit 100 for an air-conditioning apparatus is capable of preventing formation of a gap between the fin end portion 7*a* and the air passage blocking object 50, thereby being capable of more reliably preventing inflow of air outside the outdoor unit 100 into the hairpin portions 6*a* of the outdoor heat exchanger 90.

(3) In the outdoor unit 100 for an air-conditioning apparatus according to Embodiment 1, the heat transfer tubes 1 are inserted into the cutout portions 3 formed in the fins 2. The cutout portions 3 are opened at one end of the fin 2 in the direction orthogonal to the longitudinal direction of the fin 2, and extend from the one end toward an other end of the fin 2. In the outdoor heat exchanger 90, the other end of the fin 2 is oriented toward a side on which the air passage blocking object 50 is arranged.

With such a configuration, in the outdoor unit 100 for an air-conditioning apparatus, the edge portions 2*b* of the fin 2 are arranged between the air passage blocking object 50 and the heat transfer tubes 1, and hence the air passage blocking object 50 and the heat transfer tubes 1 are prevented from being brought into direct contact with each other. With this, even when the outdoor unit 100 is to be assembled, the air passage blocking object 50 and the heat transfer tubes 1 are prevented from being brought into contact with each other, thereby being capable of preventing damage on the heat transfer tubes 1.

(4) In the outdoor unit 100 for an air-conditioning apparatus according to Embodiment 1, the air passage blocking object 50 has a distal end portion held in abutment against the fin 2.

With such a configuration, in the outdoor unit 100 for an air-conditioning apparatus, a gap is prevented from being formed between the fin end portion 7*a* and the air passage blocking object 50, thereby being capable of more reliably suppressing inflow of air outside the outdoor unit 100 into the hairpin portions 6*a* of the outdoor heat exchanger 90.

(5) In the outdoor unit 100 for an air-conditioning apparatus according to Embodiment 1, the air passage blocking object 50 is provided at a position on the downstream side in the flow of air with respect to the outdoor heat exchanger 90.

With such a configuration, the outdoor unit 100 for an air-conditioning apparatus is capable of attaining an effect similar to that of the above-mentioned item (1).

(6) The outdoor unit 100 for an air-conditioning apparatus according to

Embodiment 1 has a feature in that the heat transfer tube 1 has an elongate sectional shape, and is arranged so that a longitudinal axis of the elongate shape is horizontally oriented.

With such a configuration, in the outdoor unit 100 for an air-conditioning apparatus, a flat tube which is advantageous for heat exchange but is less likely to remove the dew condensation water therefrom can be used as the heat transfer tube 1. Therefore, dew condensation and frost formation are prevented from occurring on the flat tube which is less likely to remove the dew condensation water therefrom, thereby being capable of preventing damage on the hairpin portion 6*a* due to freezing.

<Modification Example of Embodiment 1>

In Embodiment 1, the upstream-side heat exchange portion 91 and the downstream-side heat exchange portion 92 each having the L shape are arrayed on the upstream side and the downstream side in the air passage 63. Therefore, when the upstream-side heat exchange portion 91 and the downstream-side heat exchange portion 92 have a configuration in which ends of the respective hairpin portions 6*a* are aligned, the lengths of the heat transfer tubes 1 differ. When the outdoor heat exchanger 90 has such a configuration, the number of components required for manufacturing increases. Therefore, the heat transfer tubes 1 having the same length for both the upstream-side heat exchange portion 91 and the downstream-side heat exchange portion 92 can also be used.

Figure 11:
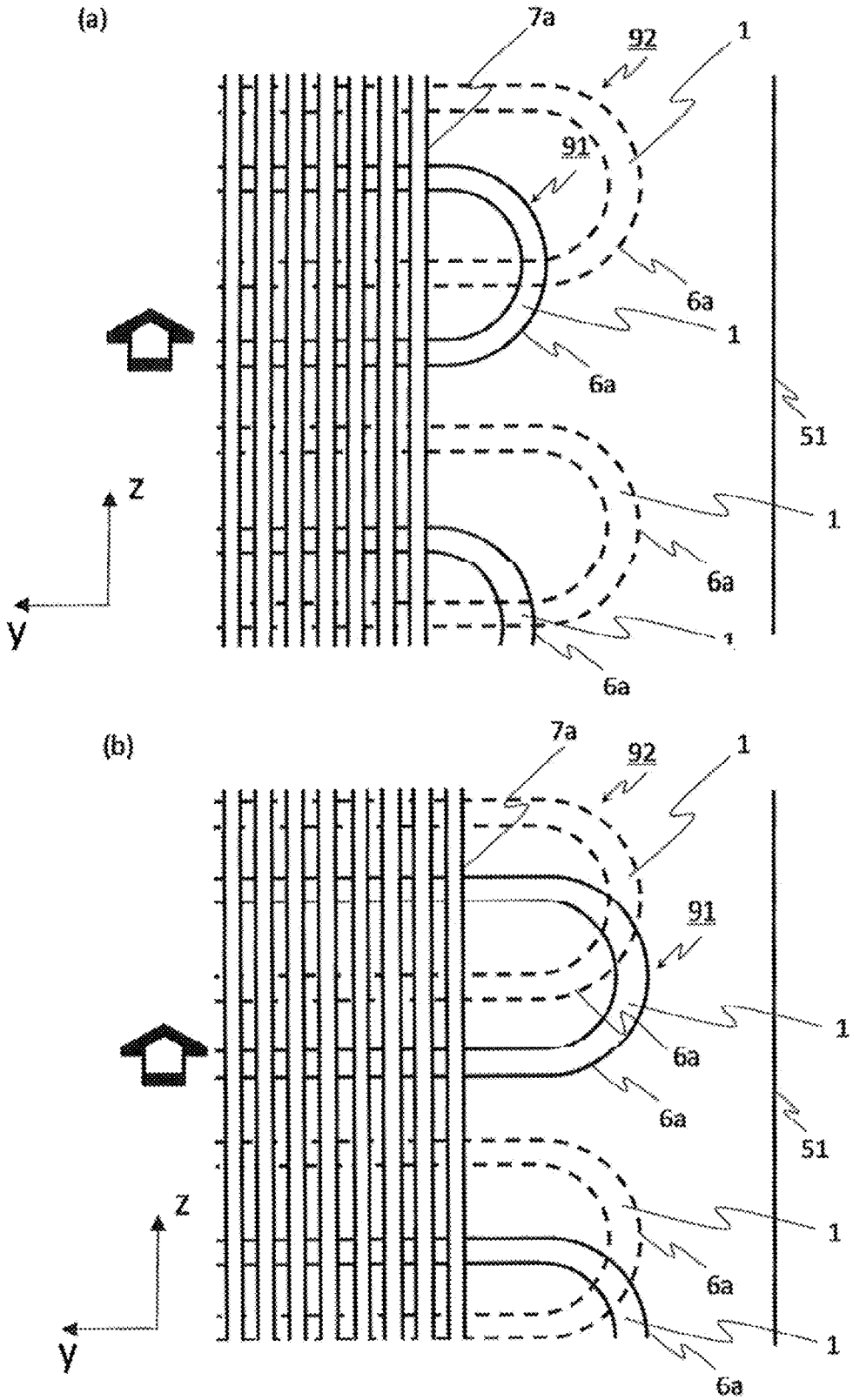
FIG. 11 are side views for illustrating the hairpin portions of the outdoor heat exchanger of the outdoor unit according to Embodiment 1 of the present invention.

FIG. 11 are side views for illustrating the hairpin portions 6*a* of the outdoor heat exchanger 90 of the outdoor unit 100 according to Embodiment 1 of the present invention. FIG. 11(*a*) is an explanatory view for illustrating the hairpin portions 6*a* in a case in which the heat transfer tubes 1 of the outdoor heat exchanger 90 have the same length. FIG. 11(*b*) is an explanatory view for illustrating the hairpin portions 6*a* in a case in which the heat transfer tubes 1 of the outdoor heat exchanger 90 according to Embodiment 1 of the present invention have different lengths for the upstream-side heat exchange portion 91 and the downstream-side heat exchange portion 92. In FIGS. 11, the heat transfer tubes 1 of the upstream-side heat exchange portion 91 are indicated by solid lines, and the heat transfer tubes 1 of the downstream-side heat exchange portion 92 are indicated by broken lines. Moreover, for easy understanding of the illustration, the heat transfer tubes 1 of the upstream-side heat exchange portion 91 and the heat transfer tubes 1 of the downstream-side heat exchange portion 92 are illustrated with displacement in the up-and-down direction.

As illustrated in FIG. 11(*a*), when the outdoor heat exchanger 90 has such a configuration that the heat transfer tubes 1 have the same length for the upstream-side heat exchange portion 91 and the downstream-side heat exchange portion 92 and that the fin end portions 7*a* are aligned, the hairpin portions 6*a* of the upstream-side heat exchange portion 91, which are bent into the L shape and provided at a position on an outer side, have a small length. Meanwhile, as illustrated in FIG. 11(*b*), when the heat transfer tubes 1 have different lengths for the upstream-side heat exchange portion 91 and the downstream-side heat exchange portion 92, the ends of the hairpin portions 6*a* can be aligned while the fin end portions 7*a* are aligned.

As illustrated in FIG. 11(*a*), when the outdoor heat exchanger 90 has such a configuration that the heat transfer tubes 1 have the same length for the upstream-side heat exchange portion 91 and the downstream-side heat exchange portion 92 and that the fin end portions 7*a* are aligned, there is an advantage in that the heat transfer tubes 1 having the same length can be used. However, as illustrated in FIG. 11(*a*), the end portions of the hairpin portions 6*a* cannot be aligned, and the hairpin portions 6*a* of the upstream-side heat exchange portion 91 are retreated in the y-direction of FIG. 11 with respect to the hairpin portions 6*a* of the downstream-side heat exchange portion 92. When the heat transfer tubes 1 have the same length for the upstream-side heat exchange portion 91 and the downstream-side heat exchange portion 92 in FIG. 11(*a*) and the downstream-side heat exchange portion 92 in FIG. 11(*b*), only the hairpin portions 6*a* of the upstream-side heat exchange portion 91 in FIG. 11(*a*) have a small length, and hence the arc portions 6*c* of the hairpin portions 6*a* are positioned close to the fin end portion 7*a*. As a result, in order to align the fin end portions 7*a* of the upstream-side heat exchange portion 91 and the downstream-side heat exchange portion 92, it is required that the number of fins 2 of the downstream-side heat exchange portion 92, which can originally receive a larger number of fins 2 mounted thereto than the upstream-side heat exchanger portion 91, be reduced so as to conform to the upstream-side heat exchange portion 91. Therefore, in the viewpoint of heat exchange performance, it is advantageous for the outdoor heat exchanger 90 to have a configuration in which the length of the heat transfer tubes 1 of the upstream-side heat exchange portion 91 is set larger than the length of the heat transfer tubes 1 of the downstream-side heat exchange portion 92 and in which the ends of the hairpin portions 6*a* are aligned.

Embodiment 2

In an outdoor unit 200 for an air-conditioning apparatus according to Embodiment 2 of the present invention, a position of the air passage blocking object 50 is changed from that of the outdoor unit 100 according to Embodiment 1. With regard to the outdoor unit 200 according to Embodiment 2, changes from Embodiment 1 are mainly described. With regard to components of the outdoor unit 200 according to Embodiment 2, components having the same functions in the drawings are denoted by the same reference symbols as those of the drawings used for description of Embodiment 1.

Figure 12:
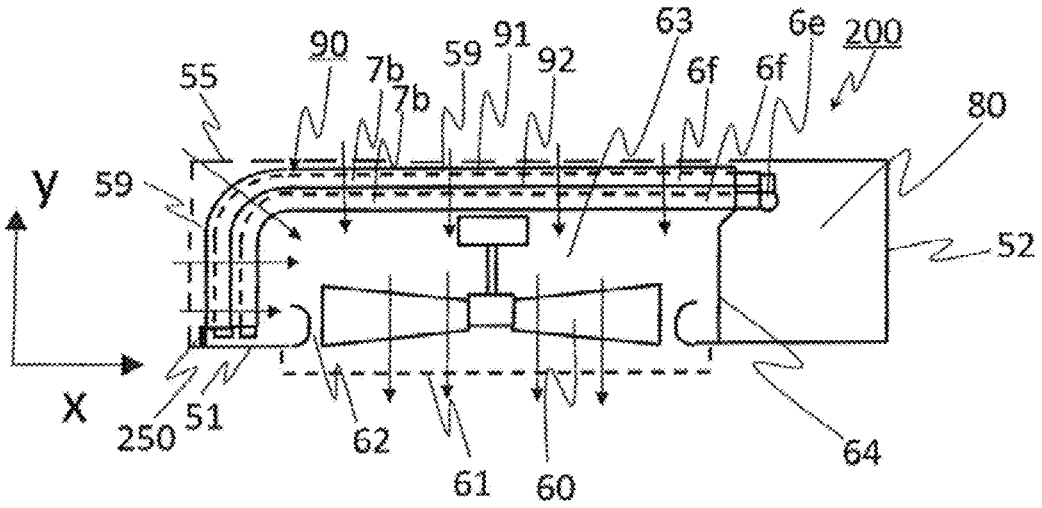
FIG. 12 is an explanatory view for illustrating a horizontal cross section of an outdoor unit for an air-conditioning apparatus according to Embodiment 2 of the present invention.
Figure 13:
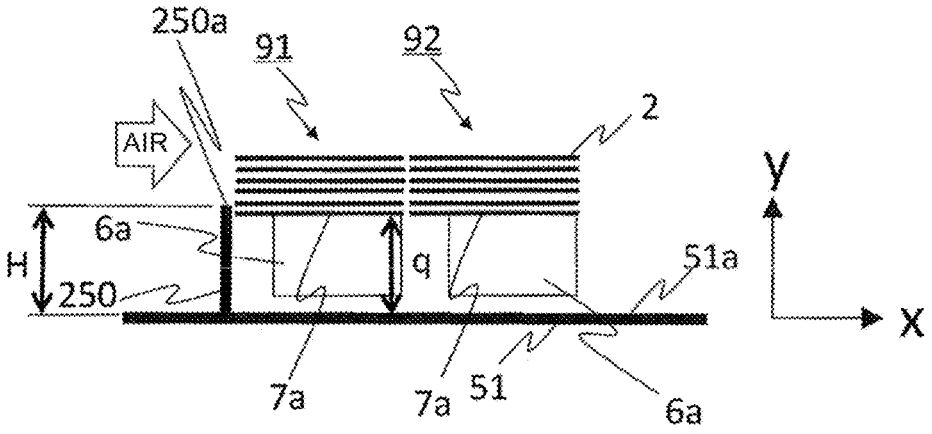
FIG. 13 is an enlarged view for illustrating a periphery of the hairpin portions of the outdoor heat exchanger in FIG. 12.

FIG. 12 is an explanatory view for illustrating a horizontal cross section of the outdoor unit 200 for an air-conditioning apparatus according to Embodiment 2 of the present invention. FIG. 13 is an enlarged view for illustrating a periphery of the hairpin portions 6*a* of the outdoor heat exchanger 90 in FIG. 12. The cross section illustrated in FIG. 12 corresponds to the A-A cross section of Embodiment 1 in FIG. 2.

In Embodiment 2, an air passage blocking object 250 is arranged on an upstream side of the hairpin portions 6*a* of the upstream-side heat exchange portion 91. The air passage blocking object 250 extends from the front panel 51 toward the inner side of the air passage 63 in parallel with the longitudinal direction of the heat transfer tube 1, that is, the flow direction of the refrigerant flowing inside the heat transfer tube 1. Moreover, similarly to Embodiment 1, a height H of the air passage blocking object 250 from the wall surface 51*a* on the inner side of the front panel 51 is set equal to or larger than the distance "q" from the front panel 51 to the fin end portion 7*a*.

In FIG. 12 and FIG. 13, the air passage blocking object 250 is provided upright on the wall surface 51*a* on the inner side of the front panel 51, but the present invention is not limited to this configuration. For example, the air passage blocking object 250 may be formed integrally with the rear panel 55. That is, it is only required that the air passage blocking object 250 block the upstream side of the hairpin portions 6*a* of the upstream-side heat exchange portion 91 and suppress inflow of the air to a space from the front panel 51 to the fin end portions 7*a*.

Moreover, in Embodiment 2, the cutout portions 3 of the fins 2 of the upstream-side heat exchange portion 91 are formed so as to be opened on the downstream side. As illustrated in FIG. 12 and FIG. 13, the heat transfer tubes 1 of the upstream-side heat exchange portion 91 are arranged close to the downstream side. Similarly to the outdoor unit 100 according to Embodiment 1, the heat transfer tube 1 is arranged apart from the air passage blocking object 250 by a certain distance, thereby being capable of preventing damage due to contact between the heat transfer tubes 1 and the air passage blocking object 250.

<Effect of Embodiment 2>

(7) In the outdoor unit 200 for an air-conditioning apparatus according to Embodiment 2, the air passage blocking object 250 is provided at a position on an upstream side in the flow of the air with respect to the outdoor heat exchanger 90. With such a configuration, the effect similar to those of the items (1) to (6) described in Embodiment 1 can be attained. Moreover, the outdoor unit 200 for an air-conditioning apparatus according to Embodiment 2 is capable of preventing inflow of the air to the upstream-side heat exchanger portion 91 at which dew condensation and frost formation are more liable to occur. Therefore, the effect of suppressing freezing is higher as compared to the outdoor unit 100 according to Embodiment 1. Further, the air passage blocking object 250 of the outdoor unit 200 blocks the upstream side in the air passage 63, thereby being capable of preventing entry of, for example, dust, snow, or water flying from the outside of the outdoor unit 200. With such a configuration, the outdoor unit 200 is capable of not only suppressing the inflow of the air to the hairpin portions 6*a* but also preventing entry of other flying objects. Therefore, the effect of preventing damage on the hairpin portions 6*a* is higher as compared to the outdoor unit 100 according to Embodiment 1.

Moreover, when the air passage blocking object 250 is arranged on the upstream side of the upstream-side heat exchange portion 91, the air having passed through the fins 2 of the upstream-side heat exchange portion 91 may flow into the hairpin portions 6*a* of the downstream-side heat exchange portion 92 through a space between the upstream-side heat exchange portion 91 and the downstream-side heat exchange portion 92. However, the air having passed through the fins 2 of the upstream-side heat exchange portion 91 is dehumidified through heat exchange in the upstream-side heat exchange portion 91. Therefore, even when the air flows into the hairpin portions 6*a*, frost formation is less liable to occur. Moreover, similarly to Embodiment 1, the effect of suppressing inflow of the air into the hairpin portions 6*a* can be further enhanced by holding a distal end portion 250*a* of the air passage blocking object 250 in abutment against the fin 2.

REFERENCE SIGNS LIST

1 heat transfer tube 2 fin 2*b* edge portion 3 cutout portion 4 compressor 6*a* hairpin portion 6*b* horizontal portion 6*c* arc portion 6*d* horizontal portion 6*e* joint portion 6*f* pipe portion 7*a* fin end portion 7*b* fin installation portion 8*a* ice 8*b* ice 9*a* dew condensation water 9*b* dew condensation water 9*c* dew condensation water 9*d* dew condensation water 10 refrigerant circuit 11 compressor 12 pressure reducing device 13 indoor heat exchanger 14 flow switching device 15 indoor unit fan 50 air passage blocking object 50*a* distal end portion 51 front panel 51*a* wall surface 52 side panel 53 top panel 55 rear panel 56 base panel air inlet 60 outdoor unit fan 62 air outlet 63 air passage 64 separator 80 machine chamber 90 outdoor heat exchanger 91 upstream-side heat exchange portion 92 downstream-side heat exchange portion 100 outdoor unit 100*a* outdoor unit 101 indoor unit 200 outdoor unit 250 air passage blocking object 250*a* air passage blocking object H height p gap q distance

The invention claimed is:

1. An outdoor unit for an air-conditioning apparatus, comprising:

an air passage defined inside a casing;

an outdoor heat exchanger installed in the air passage;

an outdoor unit fan configured to introduce air into the outdoor heat exchanger; and an air passage blocking object configured to block a flow of part of the air in the air passage, wherein the outdoor heat exchanger includes a heat transfer tube configured to allow refrigerant to pass therein, and a fin connected to the heat transfer tube, wherein the heat transfer tube includes a hairpin portion, which is a portion of the heat transfer tube bent and folded back and to which no fin is connected, wherein the heat transfer tube has an elongate sectional shape, and is arranged so that a longitudinal axis of the elongate shape is horizontally oriented, and wherein the air passage blocking object is provided upright on a wall surface defining the air passage on a side on which the hairpin portion is arranged, is disposed along a longitudinal direction of the fin, and is configured to cover the hairpin portion.

2. The outdoor unit for an air-conditioning apparatus of claim 1, wherein a height of the air passage blocking object from the wall surface is set equal to or larger than a distance from a fin end portion of the outdoor heat exchanger, which is closest from the wall surface, to the wall surface.

3. The outdoor unit for an air-conditioning apparatus of claim 1, wherein the heat transfer tube is inserted into a cutout portion formed in the fin, wherein the cutout portion is opened at one end of the fin in a direction orthogonal to a longitudinal direction of the fin, and extends from the one end toward an other end of the fin, and wherein, in the outdoor heat exchanger, the other end of the fin is arranged so as to be oriented toward the air passage blocking object side.

4. The outdoor unit for an air-conditioning apparatus of claim 1, wherein the air passage blocking object has a distal end portion held in abutment against the fin.

5. The outdoor unit for an air-conditioning apparatus of claim 1, wherein the air passage blocking object is arranged on a downstream side in a flow of the air with respect to the outdoor heat exchanger.

6. The outdoor unit for an air-conditioning apparatus of claim 1, wherein the air passage blocking object is arranged on an upstream side in a flow of the air with respect to the outdoor heat exchanger.

7. An outdoor unit for an air-conditioning apparatus, comprising: an air passage defined inside a casing; an outdoor heat exchanger installed in the air passage; an outdoor unit fan configured to introduce air into the outdoor heat exchanger; and an air passage blocking object configured to block a flow of part of the air in the air passage, wherein the outdoor heat exchanger includes a heat transfer tube configured to allow refrigerant to pass therein, and a fin connected to the heat transfer tube, wherein the heat transfer tube includes a hairpin portion, Which is a portion of the heat transfer tube bent and folded back and to which no fin is connected, wherein the heat transfer tube has an elongate sectional shape, and is arranged so that a longitudinal axis of the elongate shape is horizontally oriented, and wherein the air passage Hocking object is provided upright on a wall surface defining the air passage on a side on which the hairpin portion is arranged, is disposed along a longitudinal direction of the fin, and is configured to block airflow in a space in the air passage which is defined between the wall surface forming the air passage on the side on Which the hairpin portion is arranged, and an end surface of the fin on the side on which the hairpin portion is arranged.

* * * * *